US005895295A

United States Patent [19]

Harada

[11] Patent Number: 5,895,295

[45] Date of Patent: Apr. 20, 1999

[54] BULB SOCKET

[75] Inventor: Tadashi Harada, Shizuoka, Japan

[73] Assignee: Koito Manufacturing Co., LTD., Tokyo, Japan

[21] Appl. No.: 08/878,577

[22] Filed: Jun. 19, 1997

[51] Int. Cl.[6] ..... H01R 17/00

[52] U.S. Cl. ..... 439/699.2

[58] Field of Search ..... 439/699.2, 619, 439/419, 752

[56] References Cited

U.S. PATENT DOCUMENTS

| | | | |
|---|---|---|---|
| 4,752,241 | 6/1988 | Matsuoka et al. | 439/619 |
| 4,871,331 | 10/1989 | Kondo et al. | 439/736 |
| 4,957,455 | 9/1990 | Horiuchi et al. | 439/548 |
| 5,286,223 | 2/1994 | Ogawa | 439/699.2 |
| 5,538,443 | 7/1996 | Inoue et al. | 439/699.2 |

*Primary Examiner*—Neil Abrams
*Assistant Examiner*—Eugene G. Byrd
*Attorney, Agent, or Firm*—Sughrue, Mion, Zinn, Macpeak & Seas, PLLC

[57] ABSTRACT

A bulb socket for retaining a bulb. The bulb socket includes a bulb socket main body (10) formed of synthetic resin and including a bulb insertion opening (12) formed in the bulb socket main body (10). Within the bulb insertion opening (12), there is stored a contact terminal (40A) which is formed of metal and includes a tongue-shaped bulb securing piece (42) for holding a bulb (50) inserted into the bulb insertion opening (12) in a removal preventive manner, and a tongue-shaped contact hold piece (44) contactable with an electricity energizing part disposed on the bulb side, where the bulb securing piece (42) and contact hold piece (44) are formed integrally with each other. The bulb securing piece (42) is disposed spaced apart from walls (11*a*) forming the bulb insertion opening (12) and, on the back of the bulb securing piece (42), there is provided a cantilever beam shaped elastic wall (16) which extends along the bulb securing piece (42) so as to support the bulb securing piece (42). As a result, the resistance by the bulb securing piece (42) when the bulb (50) is inserted is relatively small, whereas the resistance by the bulb securing piece (42) when the bulb (50) is relatively large.

13 Claims, 15 Drawing Sheets

BULB SOCKET

BACKGROUND OF THE INVENTION

1. Field of the Invention

The present invention relates to a bulb socket and, in particular, to a socket for a wedge base bulb (no-cap bulb) for use in an automotive lighting device or the like.

2. Related Art

A conventional bulb socket, as shown in FIG. 16, comprises a socket main body 2 which is formed of synthetic resin and includes a bulb insertion opening 3. The bulb insertion opening 3 is opened forwardly and is capable of receiving a wedge base bulb 5. Within the bulb insertion opening 3 are provided a plurality of contact terminals 4 formed of metal. Each of the contact terminals includes a tongue-piece-shaped is contact hold piece 4*a* and a tongue-piece-shaped bulb securing piece 4*b* respectively formed integrally therewith. An electricity supply wire 8 is connected to each of the contact terminals 4.

In this structure, the bulb 5 can be inserted into the bulb insertion opening 3 from above and removed from the bulb insertion opening 3, by means of the elasticity of the contact terminals (bulb securing pieces 4*b*).

That is, when the wedge base bulb 5 is inserted into the bulb insertion opening 3, the projection 6*a* of the base portion 6 of the wedge base bulb 5 is engaged with the bulb securing pieces 4*b* to thereby prevent the bulb 5 from being removed and, at the same time, the contact hold pieces 4*a* are contacted with a lead wire 7 of the bulb exposed on the surface of the base portion 6 to thereby connect the filaments 5*a* and 5*b* of the bulb 5 with the contact terminals 4 electrically.

However, in the above-mentioned conventional bulb socket, the bulb securing pieces 4*b* of the contact terminals 4 are too low in flexibility, which makes it difficult to insert and remove the bulb 5 with respect to the bulb insertion opening 3. The present inventors have studied the conventional bulb socket and have found the following discoveries.

That is, the contact terminals 4 are disposed in such a manner that they are in close proximity to the inside of the forming wall 3*a* of the bulb insertion opening 3, while the bulb securing pieces 4*b* are also extended in such a manner that they are in close proximity to the bulb insertion opening forming wall 3*a*. Due to this, when the bulb 5 is inserted into or removed from the bulb insertion opening 3, the bulb securing pieces 4*b* cannot be elastically deformed in an outward direction (in a direction to spread the bulb insertion opening 3) smoothly, which provides an obstacle to the easy insertion and removal of the bulb 5.

In view of this, the present inventors have tried to separate the bulb securing pieces 4*b* of the contact terminals 4 from the bulb insertion opening forming wall 3*a*, with the result that the bulb securing pieces 4*b* can be elastically deformed smoothly with the insertion of the bulb 5 and the bulb 5 can be thereby inserted and removed easily.

However, in this experiment, although the easy insertion and removal of the bulb 5 is made possible, since the spring forces of the bulb securing pieces 4*b* are weak, if the insertion and removal of the bulb 5 are repeated, then there arises a new problem that the bulb securing pieces 4*b* can be easily weakened or the bulb 5 can be removed unexpectedly.

To solve this new problem, the present inventors have conducted another experiment in which, as a member for supporting the bulb securing pieces 4*b*, a vertical wall-like cantilever beam is so disposed in the rear of the bulb securing pieces 4*b* as to extend along the bulb securing pieces 4*b*. As a result of this experiment, the present inventors have confirmed that not only the bulb 5 can be inserted easily but also the weakening of the bulb securing pieces 4*b* and the removal of the bulb 5 can be prevented effectively. This is the reason why the inventors have decided to propose the present invention.

SUMMARY OF THE INVENTION

That is, the present invention has been developed in view of the problems found in the above-mentioned conventional bulb socket and based on the knowledge of the present inventors obtained according to the above-mentioned experiments. Accordingly, it is an object of the invention to provide a bulb socket which allows a bulb not only to be fixed and held positively but also to be inserted and removed smoothly.

In attaining the above object, according to the invention, there is provided a bulb socket comprising a metal contact terminal provided within a bulb insertion opening formed in a bulb socket main body formed of synthetic resin, the contact terminal including a tongue-piece-shaped bulb securing piece for holding a bulb inserted into the bulb insertion opening in is a removal preventive manner, and a tongue-piece-shaped contact hold piece contactable with an electricity energizing part disposed on the bulb side, the bulb securing piece and contact hold piece being formed integrally with each other, wherein the bulb securing piece is spaced apart from walls forming the bulb insertion opening and, on the back of the bulb securing piece there is provided a cantilever beam shaped elastic wall which is formed integrally with the bulb socket main body and extends along the bulb securing piece toward the opening side of the bulb insertion opening so as to support the bulb securing piece.

The highly flexible bulb securing piece allows the smooth insertion of the bulb, and the elastic wall provided on the back of the bulb securing piece supports the bulb securing piece to thereby control the fatigue of the bulb securing piece and prevent the bulb against removal positively.

According to another aspect of the invention, in a bulb socket, in the leading end portion of the bulb securing piece, there is formed a bulb securing bent portion which is turned up from the inside of the bulb insertion opening upwardly of the elastic wall. In particular, when inserting the bulb into the bulb insertion opening, at first, the leading end side of the metal bulb securing piece is pushed by the bulb and is thereby elastically deformed in an outward direction (that is, in a direction to spread the bulb insertion opening). Thereafter, if the bulb securing piece is butted against the synthetic resin elastic wall situated on the back thereof, then the bulb securing piece and elastic wall are elastically deformed outwardly in an integral manner. That is, originally, a force to push the bulb 50, as shown by an arrow $P_1$ in FIG. 12, acts only on the leading end of the bulb securing piece 42 but does not act on the elastic wall. Thereafter, the force $P_1$ acts mainly on the extension leading end portions of the bulb securing piece and elastic wall, so that the bulb securing piece and elastic wall can be elastically deformed easily.

Therefore, when inserting the bulb into the bulb insertion opening, the resistance (reaction) that the bulb receives from the securing piece is small, which makes it possible to insert the bulb into the bulb insertion opening smoothly.

On the other hand, when removing the bulb from the bulb insertion opening, the bulb securing piece and elastic wall are elastically deformed outwardly in an integral manner, so that the bulb can be removed from the bulb insertion opening. In this case, a force to remove the bulb from the bulb insertion opening, as shown by an arrow $P_2$ in FIG. 13, acts from the beginning on both of the bulb securing piece and elastic wall and, in more particular, acts on the middle portions of the bulb securing piece and elastic wall in the extension direction thereof. Due to this, when the bulb is removed from the bulb insertion opening, the bulb securing piece and elastic wall are less likely to be elastically deformed than when the bulb is inserted into the bulb insertion opening. For this reason, when removing the bulb from the bulb insertion opening, the bulb is harder to slip off.

According to another aspect of the invention, in a bulb socket, the contact terminal includes a bulb securing piece in its central portion in the width direction thereof and two contact hold pieces on its two sides in the width direction thereof. While the portion of the bulb that is inserted into the bulb insertion opening is held by the bulb securing piece in a removal preventive manner, since the two sides of the bulb portion are held by the contact hold pieces, the bulb can be held in a well-balanced manner within the bulb insertion opening.

According to still another aspect of the invention, in a bulb socket, on the opposite side to the bulb insertion opening of the bulb socket main body, there is formed a connector insertion opening into which an electricity supply connector can be inserted, and the contact terminal includes a connector connection terminal which is formed integrally with the contact terminal and extends into the connector insertion opening. If the electricity supply connector is inserted into the connector insertion opening, then the bulb socket is easier to assemble and handle than a structure in which an electricity supply wire is is directly connected to a contact terminal.

According to still another aspect of the invention, in a bulb socket, a branch portion between the contact terminal and the connector connection terminal is bent in such a manner that it has a crank-shaped longitudinal section. The crank portion, which extends at right angles to a direction in which the contact terminal and the connector connection terminal extend, makes it possible for the contact terminal to be stored properly within the bulb insertion opening.

According to still another aspect of the invention, in a bulb socket, in the peripheral edge of the flat crank portion of the contact terminal, there is provided a frame-shaped vertical wall which is formed integrally with the crank portion, and reinforcing beads are formed in the vertical wall. Since the frame-shaped vertical wall is engaged with a groove formed in the periphery of the contact surface of the bulb insertion opening to be contacted by the flat crank portion, the contact terminal can be stored properly within the bulb insertion opening. Also, while a load is applied to the crank portion when the bulb is inserted or removed and also when the electricity supply wire is inserted or removed, the frame-shaped vertical wall and reinforcing beads function to enhance the rigid strength of the crank portion.

According to still another aspect of the invention, in a bulb socket, between the bulb securing piece and contact hold piece, there is formed a pushing shoulder portion which is used to push the contact terminal into the bulb insertion opening from the opening side thereof and store the same at a given position within the bulb insertion opening. Because the pushing shoulder portion is situated in the substantially central portion of the contact terminal in the width direction thereof, the contact terminal can be pushed in the width direction substantially central portion thereof and thereby be pushed into the bulb insertion opening in a well-balanced manner.

According to another aspect of the invention, in a bulb socket, at a position below the pushing shoulder portion in the contact terminal, there is formed a lance which is obtained by cutting and raising a portion of the contact terminal and can be engaged with a securing portion formed on the bulb socket main body side to thereby prevent the contact terminal against removal. Although, when the contact terminal is pushed into the bulb insertion opening, the lance is contacted with the bulb insertion forming wall to thereby provide a resistance to the insertion of the contact terminal, since the lance is situated in the width direction substantially central portion of the contact terminal just below the shoulder portion on which the pushing force acts, the contact terminal can be pushed into the bulb insertion opening in a well-balanced manner.

DESCRIPTION OF THE PREFERRED EMBODIMENTS

Figure 1:
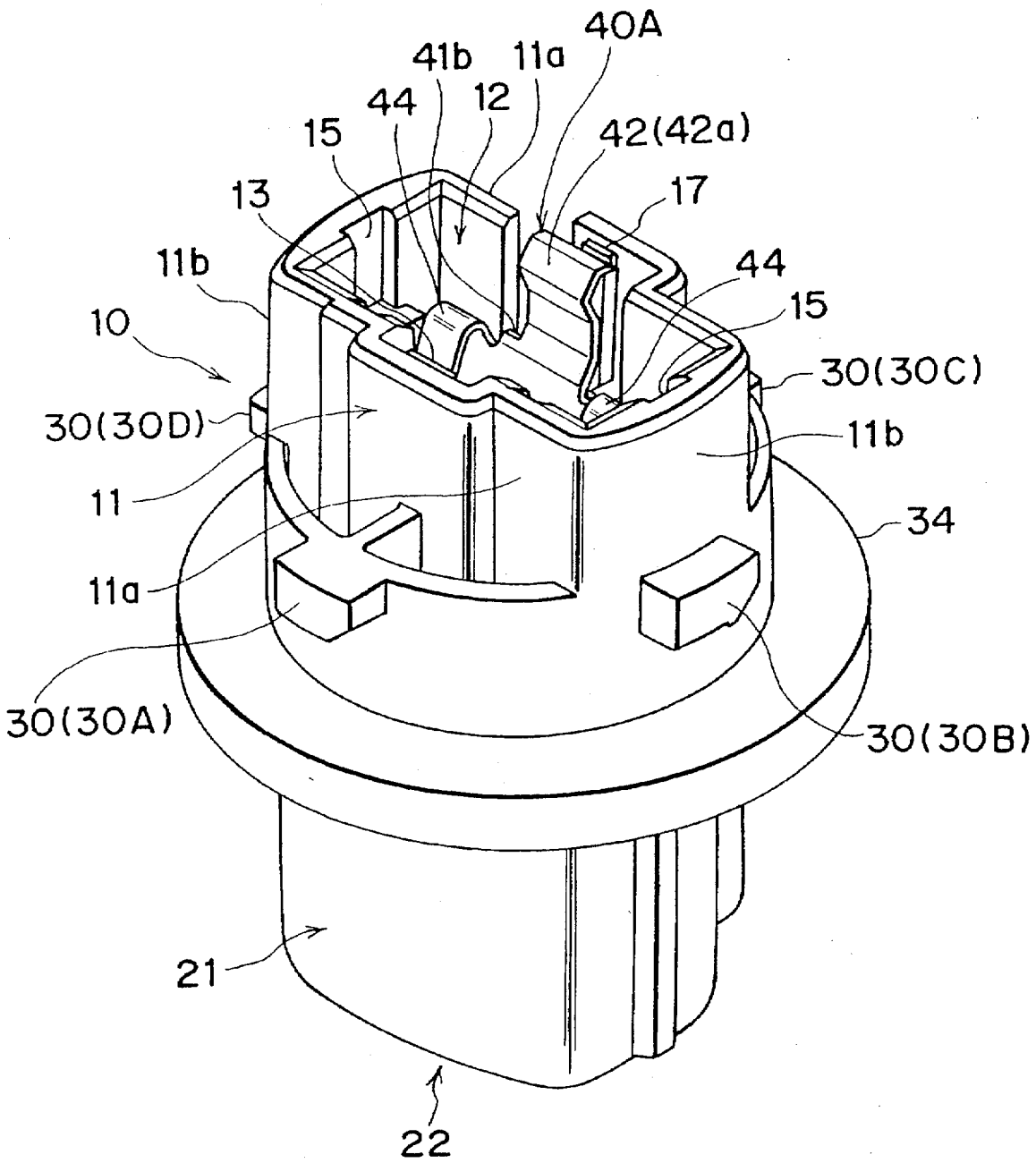
FIG. 1 is a perspective view of an embodiment of a socket for a wedge base bulb according to the invention.
Figure 2:
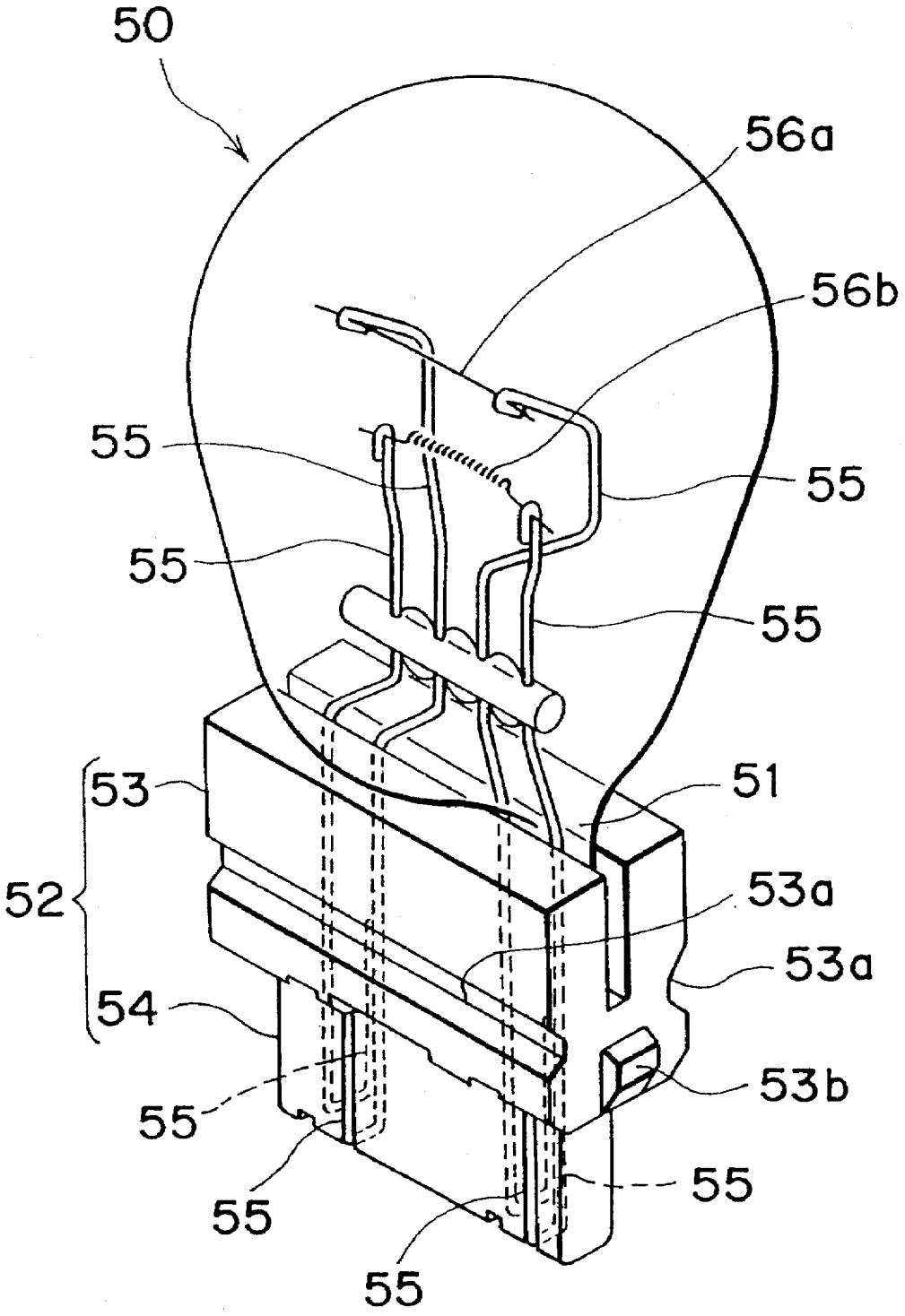
FIG. 2 is a perspective view of a wedge base bulb which is inserted into the above socket.
Figure 3:
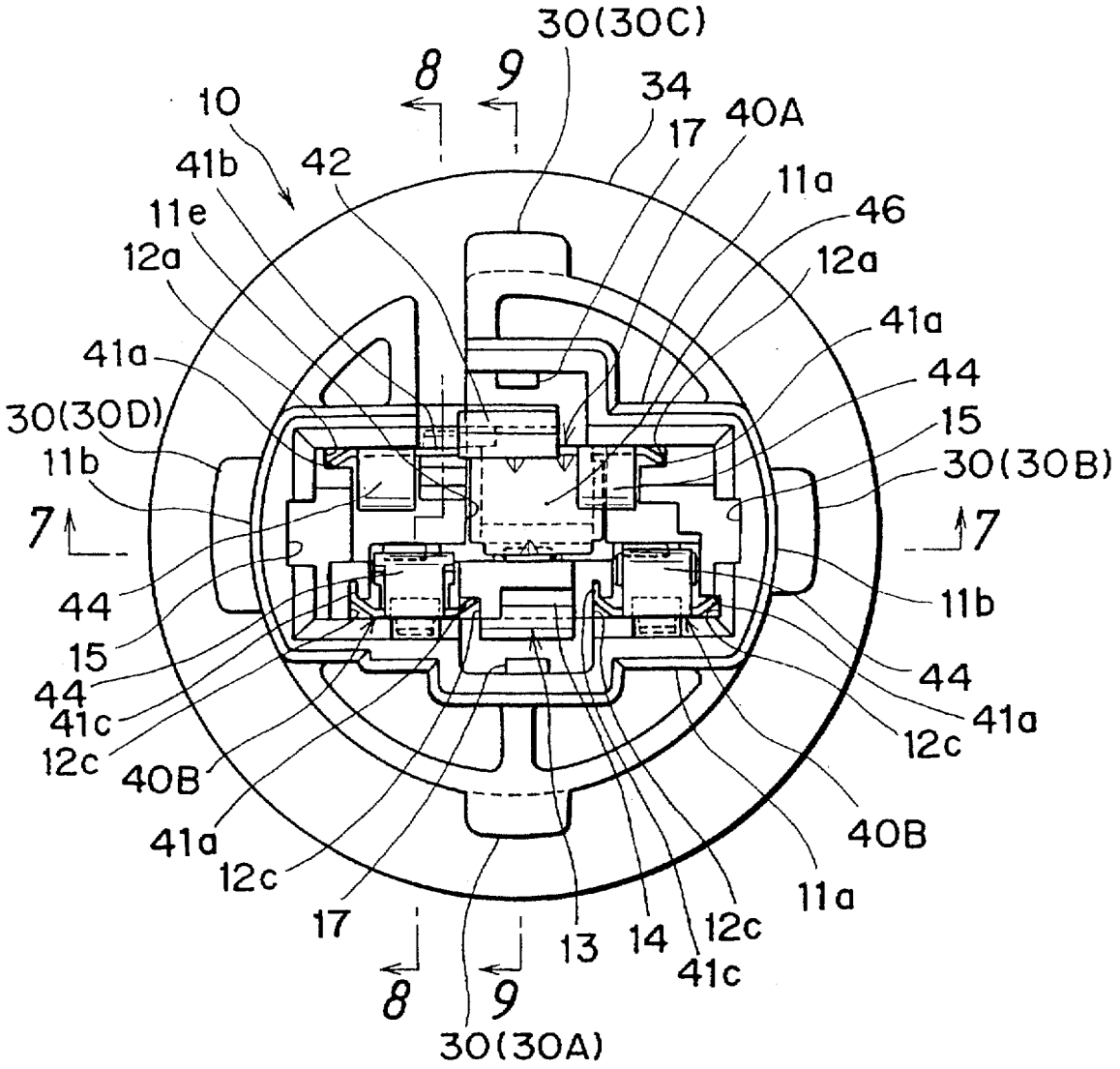
FIG. 3 is a top plan view of the above socket.
Figure 4:
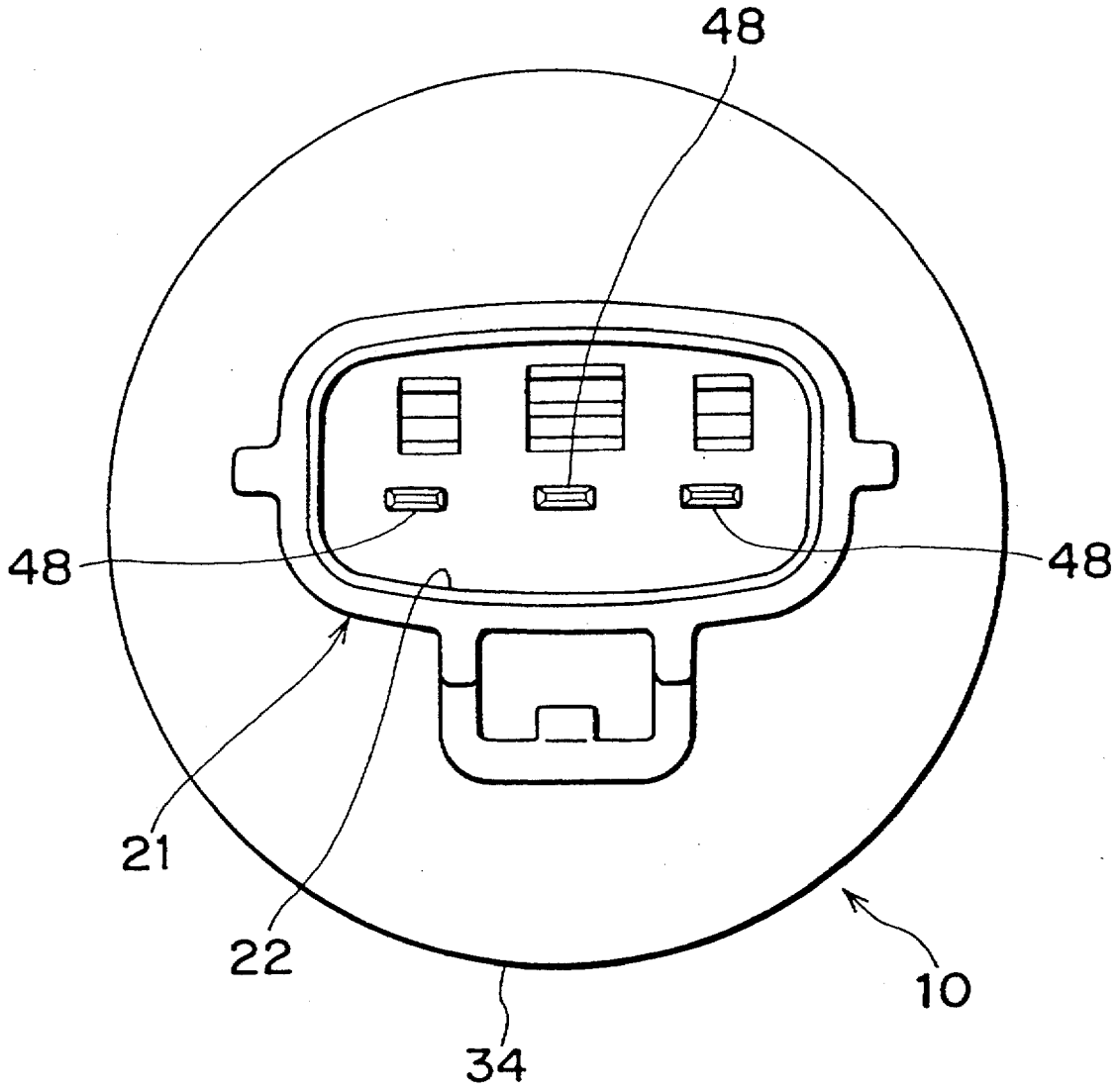
FIG. 4 is a bottom plan view of the above socket.
Figure 5:
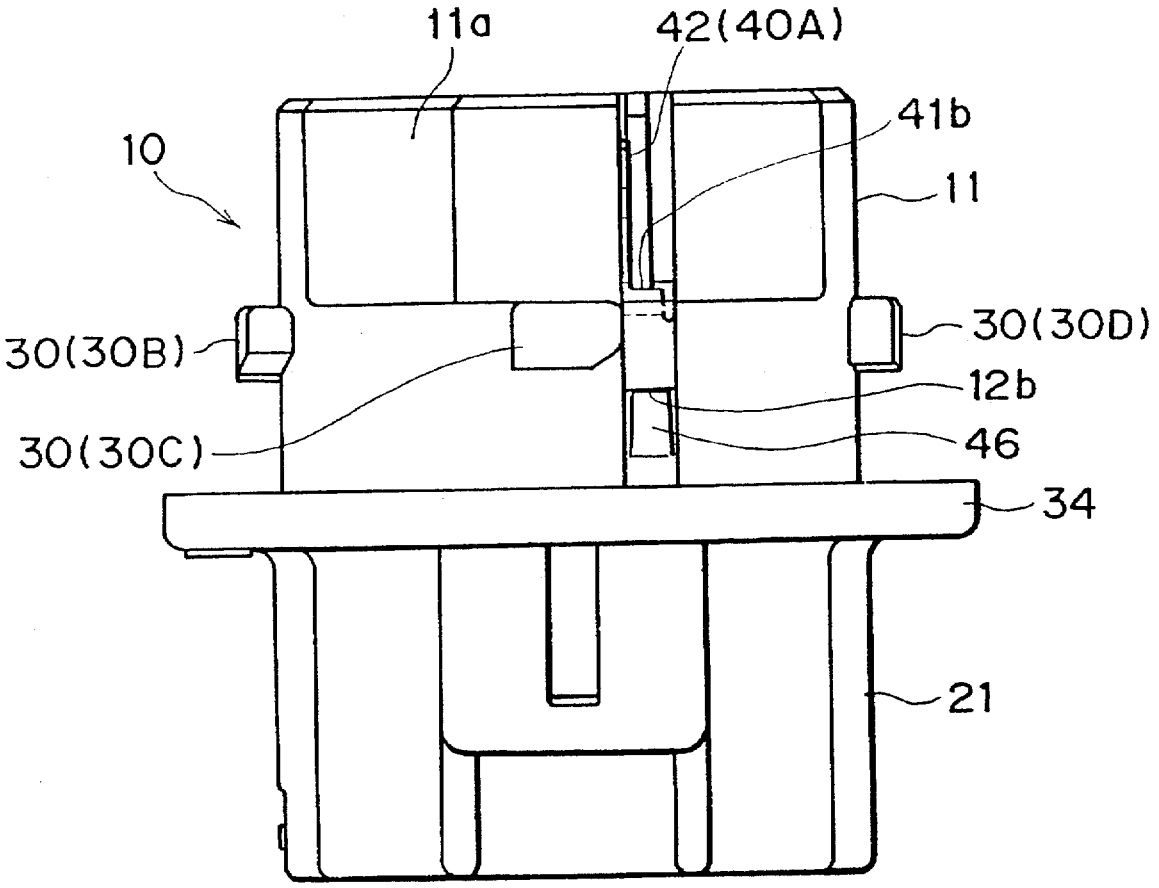
FIG. 5 is a front view of the above socket.
Figure 6:
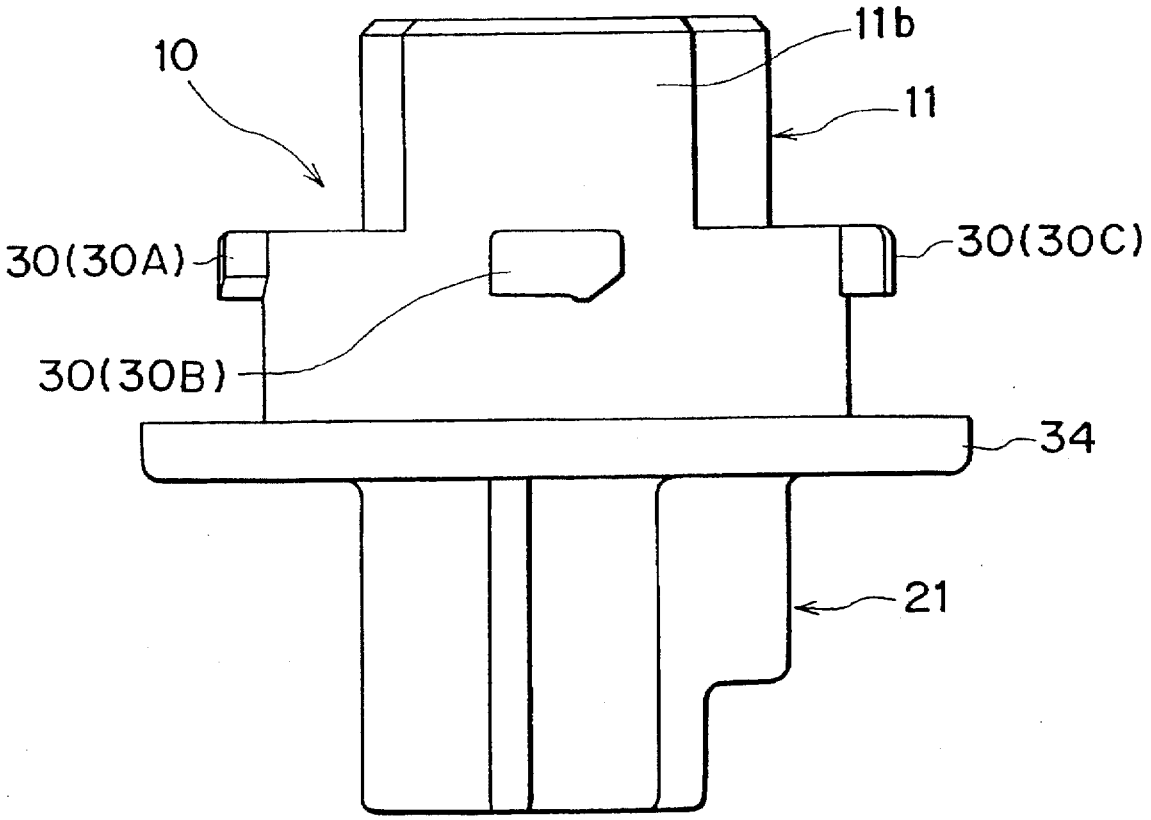
FIG. 6 is a right side view of the above socket.
Figure 7:
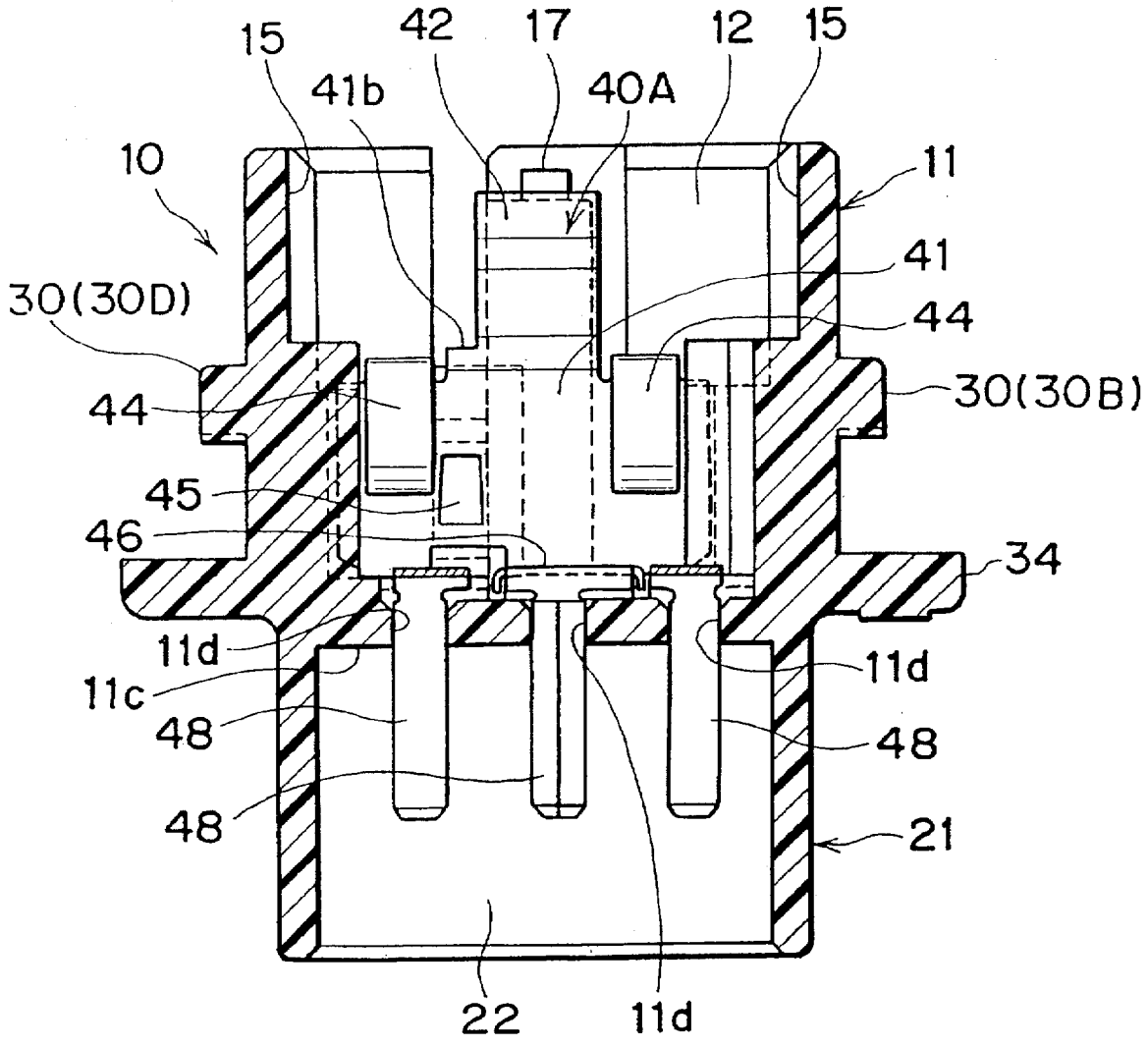
FIG. 7 is a longitudinal sectional view of the above socket taken along line 7—7 in FIG. 3.
Figure 8:
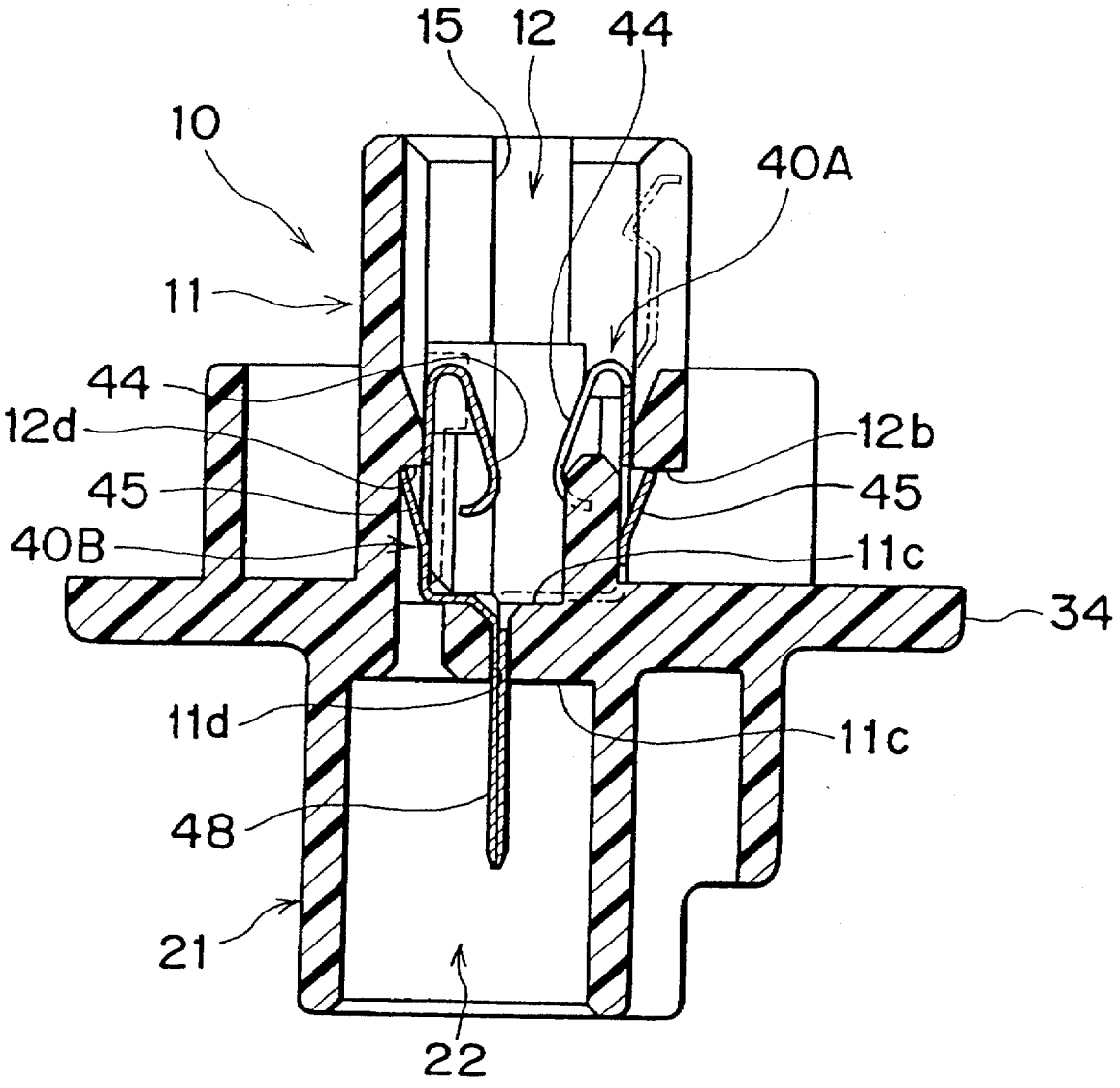
FIG. 8 is a longitudinal sectional view of the above socket taken along line 8—8 in FIG. 3.

Now, description will be given of an embodiment of a bulb socket according to the invention with reference to the accompanying drawings.

In FIGS. 1 to 15, there is shown an embodiment of a bulb socket according to the invention.

In these figures, reference character 50 designates a wedge base bulb (which is hereinafter referred to as a bulb) in which two filaments **56*a* and 56*b* with their respective two ends supported by lead supports 55 are disposed in parallel to each other within a spherical body formed of glass. A pinch-sealed flat bulb base end portion 51 is formed integrally with a rectangular-block-shaped base 52** which is formed of synthetic resin.

The base 52 of the bulb 50 is composed of a bulb hold portion 53 which is formed in a rectangular block shape and is used to envelopingly hold the bulb base end portion 51, and a flat lead wire hold portion 54 which is formed continuously with the bulb hold portion 53 and is used to hold lead wires (that is, lead supports) 55 guided from the bulb base end portion 51. Also, on the outside surface of the bulb hold portion 53, there are formed recessed grooves 53*a* which can be engaged by elastic hooks 13 and bulb securing pieces 52 provided within a bulb insertion opening (to be described later) formed in the bulb socket to thereby prevent the bulb 50 from being inadvertently removed. Further, on the outside surface of the lead wire hold portion 54, there are exposed the lead wires (lead supports) 55 which are electrically connected with the filaments 56*a* and 56*b* within the bulb 50.

A bulb socket main body 10 (which is hereinafter referred to as a socket main body) is formed of synthetic resin in a cylindrical shape. On the front end side of the socket main body 10, there are exposed three contact terminals 40A, 40B and 40B, and there is formed a bulb insertion opening 12 into which the wedge base bulb 50 can be inserted. On the rear end side of the socket main body 10, there are exposed three connection terminals 48, 48 and 48, and there is formed a connector insertion opening 22 into which an electricity supply connector 70 can be inserted. That is, the socket main body 10 is structured such that a bulb socket part 11 for insertion of the bulb 50 is formed integrally with a connector socket part 21 for insertion of the electricity supply connector 70.

Figure 9:
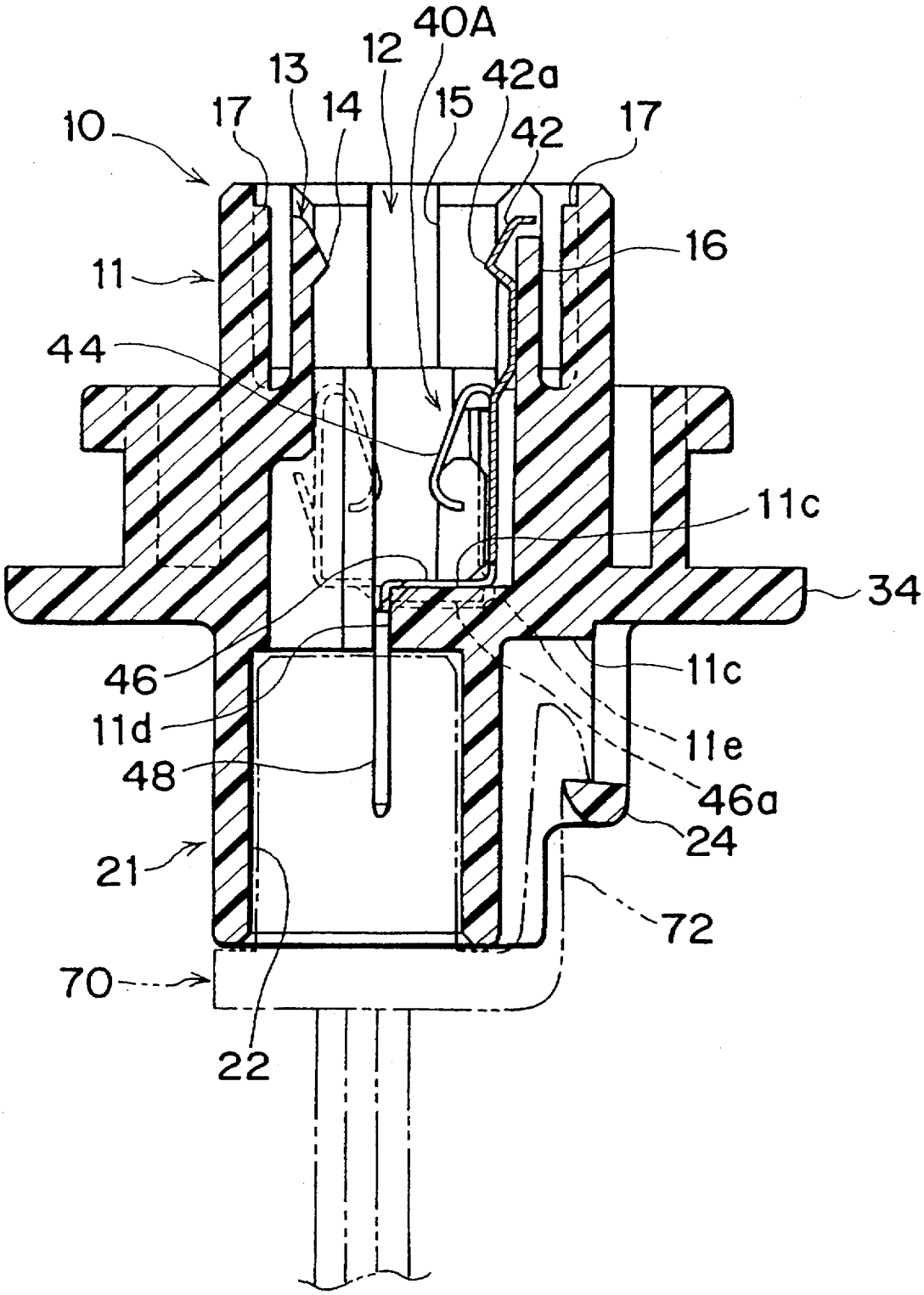
FIG. 9 is a longitudinal sectional view of the above socket taken along line 9—9 in FIG. 3.

Referring to FIG. 9, an elastic hook 72 is provided in the electricity supply connector 70. When the elastic hook 72 is engaged with a bridge-shaped securing portion 24 provided on the outside surface of the connector socket part 21, the electricity supply connector 70 is held in such a manner that it is inserted into the connector insertion opening 22.

The bulb insertion opening 12 of the bulb socket part 11 is formed in a rectangular shape which corresponds to the base 52 of the bulb 50. Also, within the bulb insertion opening 12, an elastic hook 13 and a bulb securing piece 42, which are used to hold the base 52 of the bulb 50 inserted into the bulb insertion opening 12 in a removal preventive manner, are erected in opposition to each other inside the long side surfaces 11*a* of the bulb insertion opening 12.

Also vertical grooves 15 are formed inside the narrow side surface walls 11*b* of the bulb insertion opening 12. The vertical grooves slidably receive rectangular projections 53*b* provided in the base 52 of the bulb 50 to position the bulb in the vertical and horizontal directions of the bulb insertion opening 12.

The elastic hooks 13 includes a pawl 14 in the leading end portion thereof, while the bulb securing piece 42 includes in the leading end portion thereof a bent portion 42*a* which corresponds to the pawl 14 of the elastic hook 13. The pawl 14 and bent portion 42*a* are elastically engageable with the recessed grooves 53*a* of the base 52, so that the base 52 (bulb 50) can be held in a removal preventive manner. In more detail, the elastic hook 13 is formed integrally with the socket main body 10 and extends out along the side surface walls 11 toward the opening side of the bulb insertion opening 12. On the other hand, the bulb securing piece 42 is composed of part of the metal contact terminal 40A (see FIG. 10) stored in the bulb insertion opening 12 and extends out in parallel to the side surface walls 11*a* toward the opening side of the bulb insertion opening 12. Therefore, by using the elasticity of the elastic hook 13 and bulb securing piece 42, the bulb 50 can be inserted into and removed from the bulb insertion opening 12.

Figure 10:
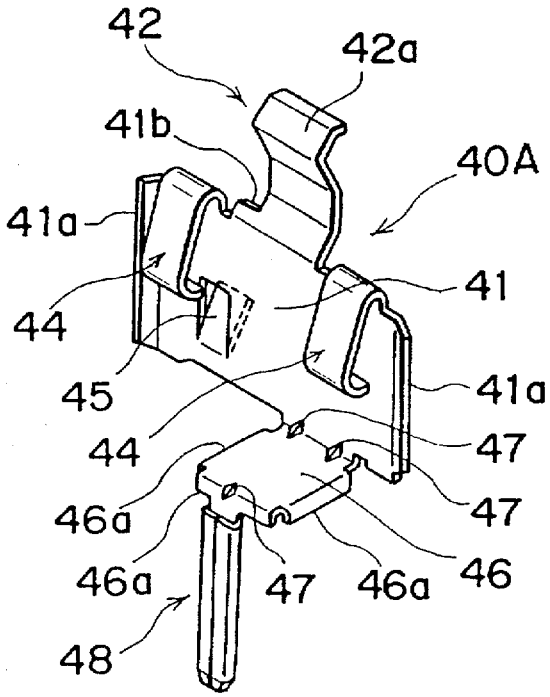
FIG. 10 is a perspective view of a terminal which is stored into the above socket.
Figure 11:
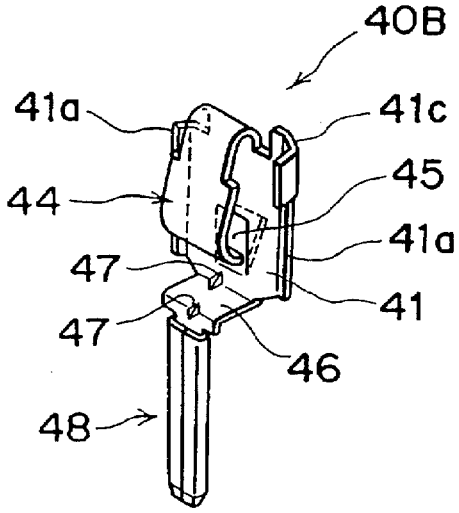
FIG. 11 is a perspective view of a terminal which is stored into the above socket.
Figure 12:
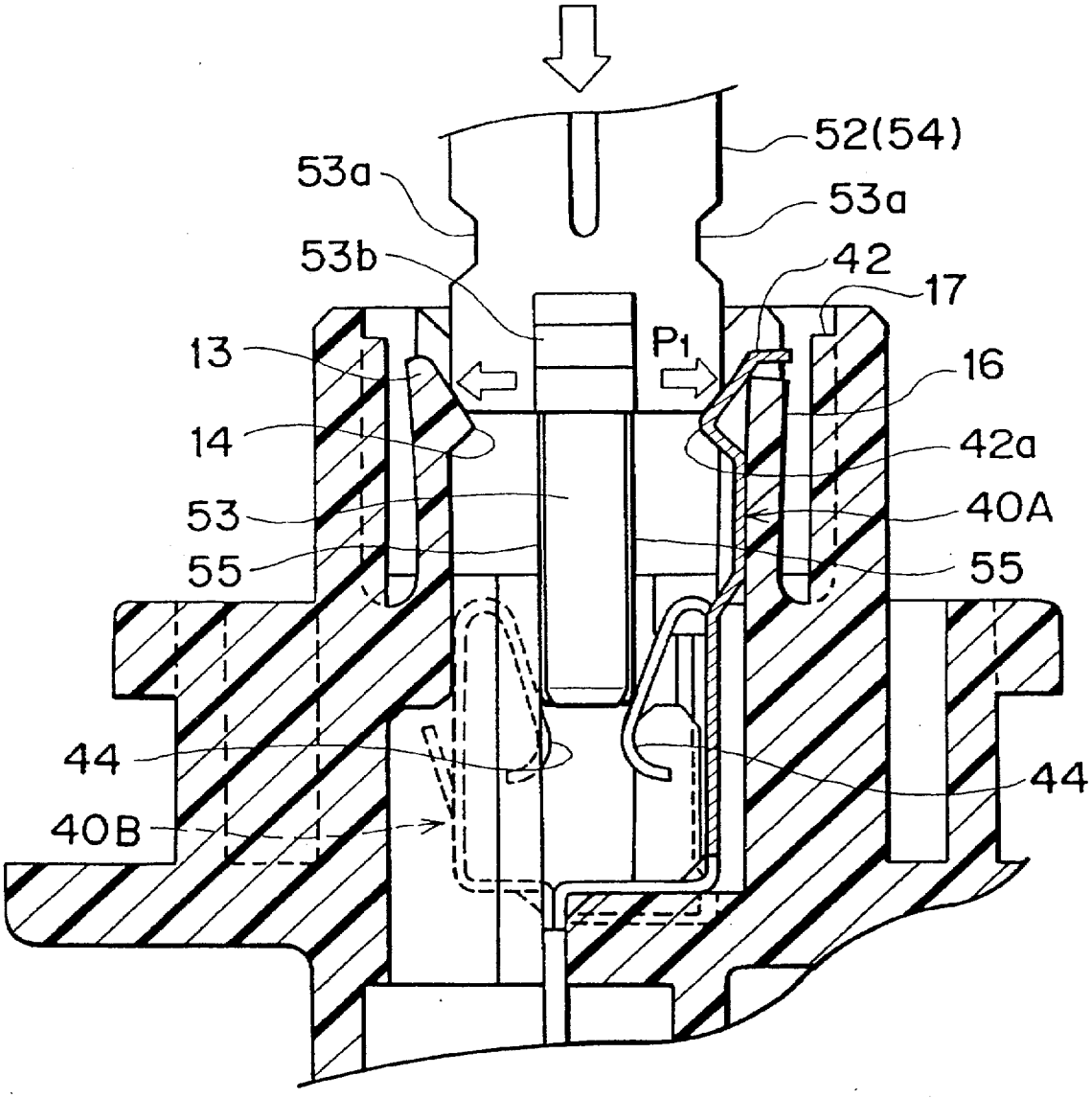
FIG. 12 is a section view of the above socket, showing the operation of bulb securing pieces when the bulb is inserted into a bulb insertion opening.
Figure 13:
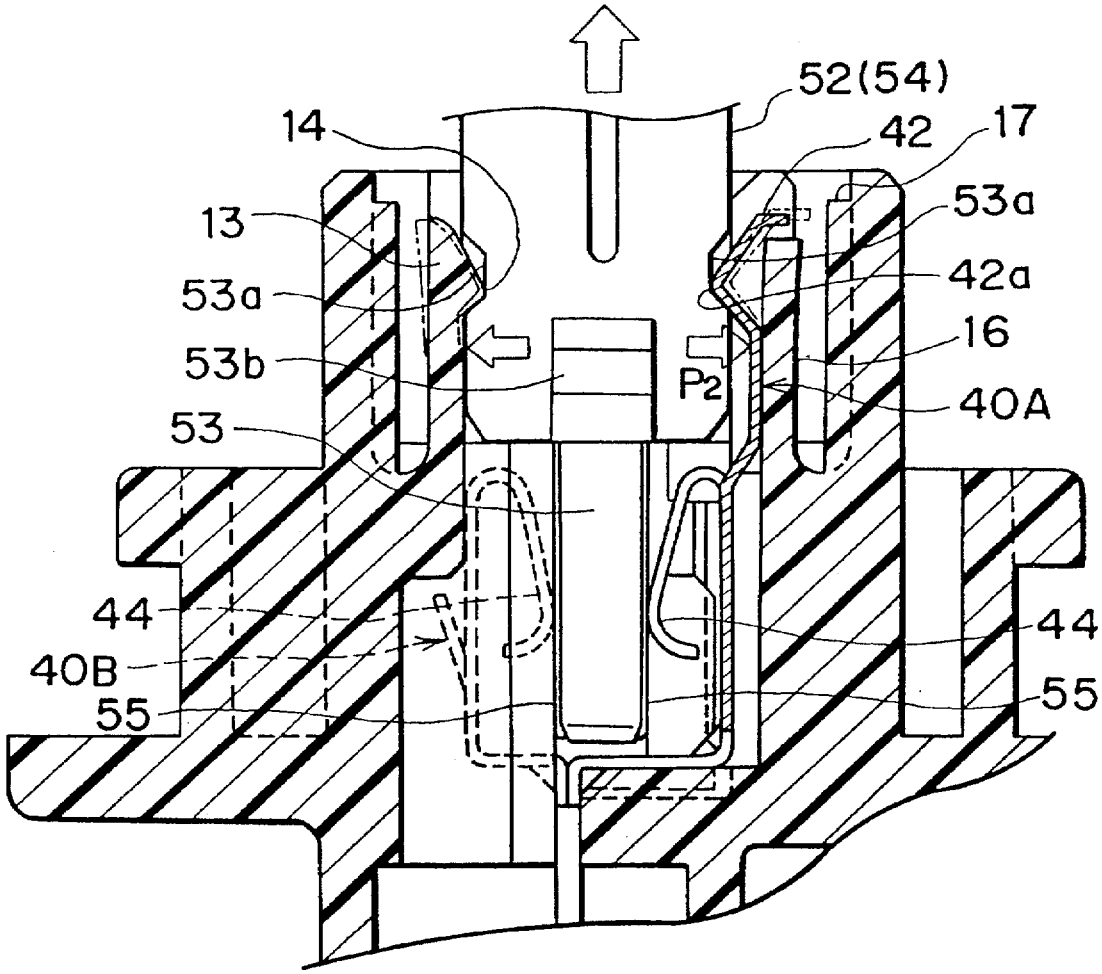
FIG. 13 is a section view of the above socket, showing the operation of the bulb securing pieces when the bulb is removed from the bulb insertion opening.
Figure 14:
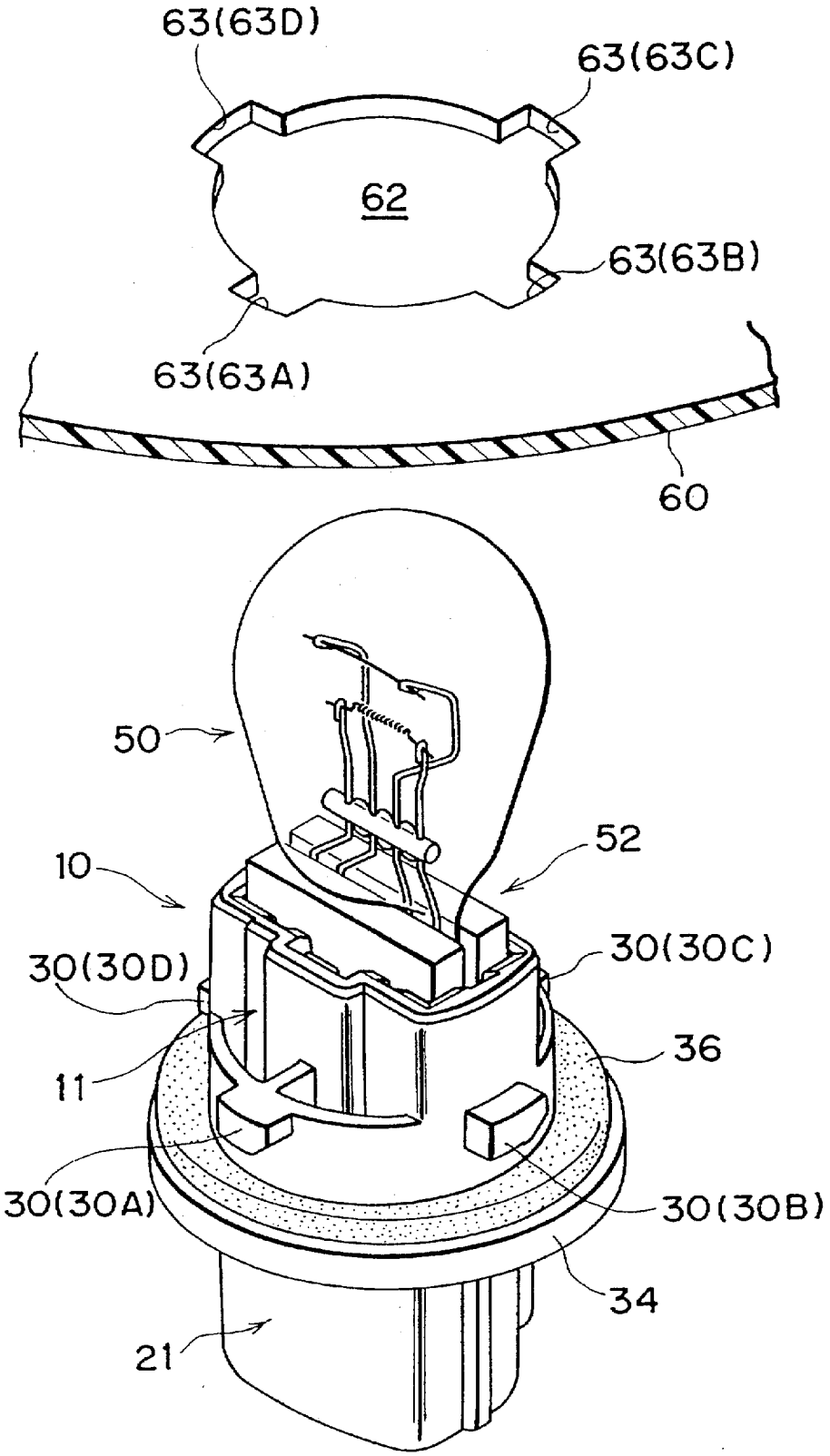
FIG. 14 is a perspective view of the bulb socket with the bulb inserted thereinto and a socket mounting hole into which the same socket is to be mounted.
Figure 15:
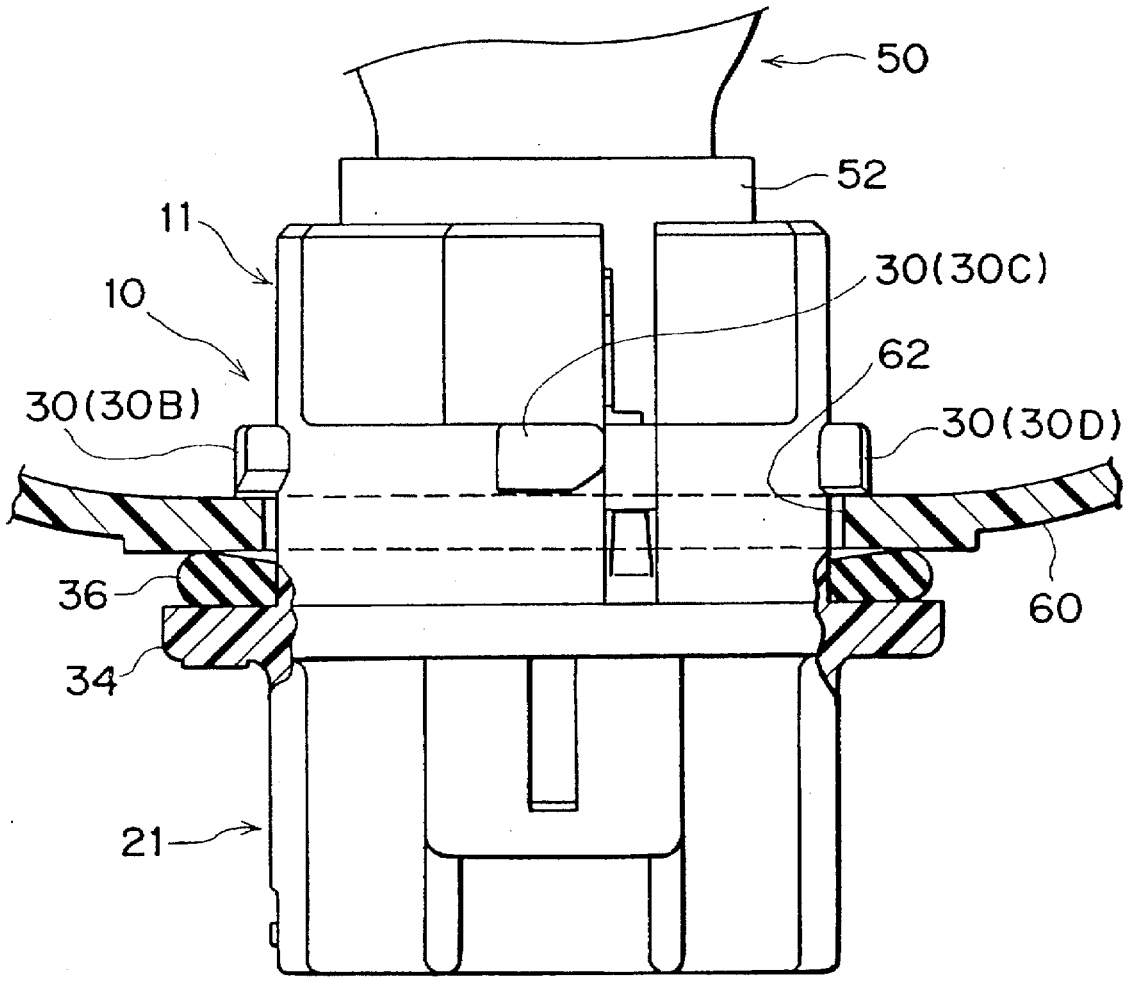
FIG. 15 is a sectional view of the periphery of the socket mounting hole into which the bulb socket with the bulb inserted integrally thereinto is mounted.
Figure 16:
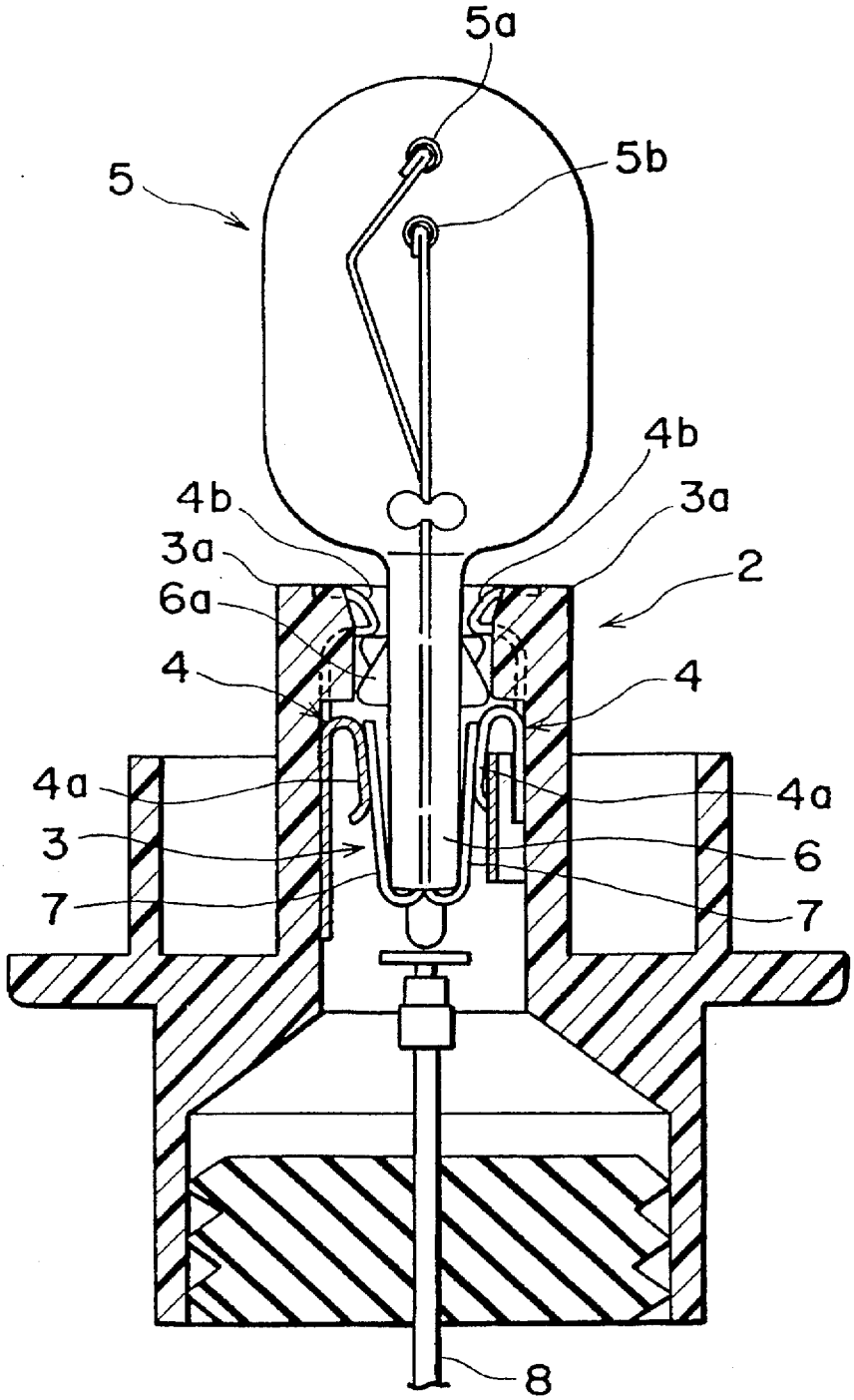
FIG. 16 PRIOR ART
FIG. 16 is a sectional view of the periphery of the socket mounting hole into which a conventional bulb socket with a bulb inserted integrally thereinto is mounted.

Also, within the bulb insertion opening 12, there are stored a metal contact terminal 40A shown in FIG. 10 and two metal contact terminals 40B shown in FIG. 11 in such a manner that the former terminal 40A is opposed to the latter terminals 40B, so that the two filaments 56*a* and 56*b* within the bulb 50 inserted into the bulb insertion opening 12 can be energized electrically. Referring to the structure of the contact terminal 40A, the contact terminal 40A includes a wide plate-like base portion 41, a tongue-piece-shaped bulb securing piece 42 formed continuously with the substantial central portion of the base portion 41 in the width direction thereof for holding the bulb 50 in a removal preventive manner, and two tongue-piece-shaped contact hold pieces 44 which are respectively formed continuously with and turned down from the right and left side edge portions of the plate-like base portion 41 and also which can be pressed against the lead wires 55 exposed on the base 52 of the bulb 50 to thereby hold the same.

A rectangular bottom surface portion 46 which has a crank-shaped (i.e., Z-shaped) longitudinal section is provided continuously with the plate-like base portion 41. Further, extending downwardly from the bottom surface portion 46 is a connector connection terminal 48 which extends away from the contact terminal 40A into the connector insertion opening 22.

The flat rectangular bottom surface portion 46, forming the crank portion, is contacted with the bottom surface wall 11*c* of the bulb insertion opening 12 to stabilize the contact terminal 40A within the bulb insertion opening 12. Also, along the peripheral edges of the rectangular bottom surface portion 46, there are formed vertical walls 46*a* respectively bent down and having a U-frame shape, which increases the strength of the crank portion of the contact terminal 40A. At the same time, if the vertical walls 46*a* are engaged with slits 11*e* (see FIG. 9) respectively, having a U-shaped plan view, which are respectively formed in the bottom surface walls 11*c* of the bulb insertion opening 12, then the contact terminal 40A can be stabilized further within the bulb insertion opening 12.

Also, in a bent portion between the plate-like base portion 41 and rectangular bottom surface portion 46 as well as in a bent portion between the plate-like base portion 41 and the vertical wall 46*a* on the connector connection terminal side, there are provided beads 47 so that the rigidity of the crank-shaped bent portions of the contact terminal 40A can be increased.

Further, in the right and left side edge portions of the plate-like base portion 41, there are formed belt-shaped securing pieces 41*a* which are bent obliquely forwardly and, if the belt-shaped securing pieces 41*a* are slidingly engaged with their corresponding vertical grooves 12*a* formed in the bulb insertion opening 12, then the contact terminal 40A can be positioned in the plate thickness direction.

Further, between the bulb securing piece 42 and one contact hold piece 44, there is formed a shoulder portion 41*b* which is used to push against the contact terminal 40A. Just below the shoulder portion 41*b*, there is formed a plate-spring-shaped lance 45 which is obtained by cutting and raising a portion of the plate-like base portion 41 on the back side thereof, which makes it possible to push the contact terminal 40A into the bulb insertion opening 12 smoothly.

In order to locate the contact terminal 40A into the bulb insertion opening 12, initially, the bulb securing piece 42 is pinched with fingers to thereby position the connector connection terminal 48 downwardly. Thereafter, the connector connection terminal 48 is aligned with a terminal insertion hole 11*d* formed in the bottom surface wall 11*c* of the bulb insertion opening 12, and the contact terminal 40A is pushed a given amount into the bulb insertion opening 12. Next, a pushing jig, such as a minus driver or the like, is pushed against the shoulder 41*b* to thereby bring the rectangular bottom surface portion 46 into contact with the bottom surface wall 11*c*, the vertical walls 46*a* into engagement with the slits 11*e*, and the lance 45 into engagement with an engaging portion 12*b* (see FIG. 8) provided on the bulb insertion opening side. As a result, the contact terminal 40A can be positioned in the vertical direction and can also be prevented from being removed.

Because the shoulder portion 41*b* to be pushed is situated in substantially the central portion of the contact terminal 40A in the width direction thereof above the lance 45, which causes a friction resistance when the contact terminal 40A is inserted, the contact terminal 40A can be pushed downwardly into the bulb insertion opening 12 to a given position in a well-balanced manner.

On the other hand, the contact terminal 40B includes a rectangular plate-like base portion 41, a tongue-piece-shaped contact hold piece 44 which is formed continuously with the plate-like base portion 41 and which is turned down in a forward and downward direction, and a connector connection terminal 48 which extends out from the contact terminal 40B into the connector insertion opening 22 through a rectangular bottom surface portion 46 of a crank-shaped longitudinal section formed continuously with the plate-like base portion 41. Also, in the crank-shaped bent portions of the contact terminal 40B, similarly to the contact terminal 40A, there are provided beads 47 for enhancement of the strength of the crank-shaped bent portions.

In the central portion of the plate-like base portion 41 in the right and left direction thereof, there is provided a lance 45 which is obtained by cutting and raising a portion of the plate-like base portion 41 on the back surface side thereof. Also, in one end portion of the plate-like base portion 41, there is formed an ear portion 41*c* which is used to push against the contact terminal 40B.

That is, to store the contact terminal 40B into the bulb insertion opening 12, at first, the ear portion 41*c* is pinched with fingers to thereby turn the connector connection terminal 48 downwardly, the connector connection terminal 48 is aligned to a terminal insertion hole 11*d* formed in the bottom surface wall 11*c* of the bulb insertion opening 12, and the contact terminal 40B is pushed a given amount into the bulb insertion opening 12. Next, if a pushing jig, such as a minus driver or the like, is pushed against the shoulder portion 41*b*, then not only the rectangular bottom surface portion 46 is contacted with the bottom surface wall 11*c* but also the lance 45 is engaged with an engaging portion 12*b* (see FIG. 8) formed in the bulb insertion opening side, so that contact terminal 40B can be positioned in the vertical direction and can also be prevented against removal.

Also, within the bulb insertion opening 12, the bulb securing piece 42 of the contact terminal 40A is disposed spaced apart from the wide side surface walls 11*a* forming the bulb insertion opening 12, so that the bulb 50 can be inserted into the bulb insertion opening 12 smoothly. At the same time, on the back of the bulb securing piece 42, there is provided a cantilever beam shaped elastic wall 16 which is spaced apart from the side surface walls 11*a* and extends in the extension direction of the bulb securing piece 42, in order that the elastic wall 16 can support the bulb securing piece 42.

In other words, when inserting the bulb 50 into the bulb insertion opening 12, initially the leading end sides of the synthetic resin elastic hook 13 and metal bulb securing piece 42 are respectively pushed by the bulb 50 as it is inserted and are thereby elastically deformed in an outward direction (that is, in a direction to spread the bulb insertion opening). Thereafter, if the bulb securing piece 42 is butted against the synthetic resin elastic wall 16 situated on the back thereof, then the elastic deformation of the elastic hook 13 advances and the bulb securing piece 42 and elastic wall 16 are elastically deformed outwardly together. That is, on the provision side of the contact terminal 40A, originally, a force to push in the bulb 50, as shown by an arrow $P_1$ in FIG. 12, acts only on the leading end of the bulb securing piece 42, i.e., it does not act on the elastic wall 16. Thereafter, the force $P_1$ acts on the extension leading end portions of the bulb securing piece 42 and elastic wall 16 to thereby deform the bulb securing piece 42 and elastic wall 16 elastically, so that the bulb 50 can be inserted into the bulb insertion opening 12.

Therefore, when inserting the bulb 50 into the bulb insertion opening 12, the resistance (reaction) that the bulb 50 receives from the securing piece 42 is small, which makes it possible to insert the bulb 50 into the bulb insertion opening 12 smoothly.

On the other hand, when removing the bulb 50 from the bulb insertion opening 12, on the provision side of the contact terminal 40B, the elastic hook 13 is elastically deformed and, on the provision side of the contact terminal 40A, the bulb securing piece 42 and elastic wall 16 are elastically deformed outwardly in an integral manner, so that the bulb 50 can be removed from the bulb insertion opening 12. In this case, a force to remove the bulb 50 from the bulb insertion opening 12, on the provision side of the contact terminal 40A, as shown by an arrow $P_2$ in FIG. 13, acts from the beginning on both of the bulb securing piece 42 and elastic wall 16 and, in particular, acts on the middle portions of the bulb securing piece 42 and elastic wall 16 in the extension direction thereof. Due to this, when the bulb 50 is removed from the bulb insertion opening 12, it is more difficult to elastically deform the bulb securing piece 42 and elastic wall 16 than when the bulb 50 is inserted into the bulb insertion opening 12. For this reason, when removing the bulb 50 from the bulb insertion opening 12, the resistance (reaction) that the bulb 50 experiences from the bulb securing piece 42 is correspondingly larger, which makes it difficult for the bulb 50 to slip off. In this manner, when the bulb 50 is once inserted into the bulb insertion opening 12, the bulb 50 can be fixed and held positively not only by the bulb securing piece 42 supported by the elastic wall 16 but also by the elastic hook 13.

In a state that the bulb 50 (base 52) is inserted into the bulb insertion opening 12, the tongue-piece-shaped contact hold pieces 44 of the contact terminals 40A, 40B hold between them the lead wires 55 exposed on the outside surface of the lead wire hold portion 54 and the contact terminals 40A, 40B are thereby connected with the lead wires 55 electrically.

Also, reference character 17 designates projecting strip portions which are respectively formed at positions opposed to the elastic hook 13 and elastic wall 16 respectively disposed inside the wide side surface walls 11*a*. In the insertion and removal of the bulb 50, if the elastic hook 13 and elastic wall 16 are respectively deformed a given amount or more, then they are butted against the projecting strip portions 17 so as to be prevented from further deforming, which makes it difficult for the elastic hook 13 and elastic wall 16 to be broken.

Now, at the quadrisected positions (i.e., equally spaced from each other around the circumference) of the outside surface of the socket main body 10 in the peripheral direction thereof, there are respectively provided securing projections 30 (30A, 30B, 30C, 30D) which can be engaged in a bayonet-like manner with a socket mounting hole 62 (see FIG. 14) formed in a reflector 60 to thereby retain the socket main body 10 against removal. Also, reference character 63 (63A, 63B, 63C, 63D) identifies notches which are respectively formed in the socket mounting hole 62 and are engageable with the securing projections 30 (30A, 30B, 30C, 30D) provided in the socket main body 10. Further, at a position spaced apart by a given distance from the securing projections 30 (30A, 30B, 30C, 30D) in the axial direction of the socket main body 10, there is provided a horizontal flange 34 which cooperates through a seat packing 36 with the securing projections 30 to hold the peripheral edge portion of the socket mounting hole 62.

That is, to mount the socket main body 10 into the socket mounting hole 62, with the securing projections 30 (30A, 30B, 30C, 30D) matched to the notches 63 (63A, 63B, 63C, 63D), the socket main body 10 may be pushed into the socket mounting hole 62, and, thereafter, rotated a given amount, so that the peripheral edge portion of the socket mounting hole 62 can be held by and between the securing projections 30 and horizontal flange 34 through the seat packing 64.

As can be clearly understood from the foregoing description, in a bulb socket according to the invention, while the metal tongue-piece-shaped bulb securing piece is elastically deformed, the bulb may be pushed and inserted into the bulb insertion opening, so that the bulb can be inserted into the bulb insertion opening lightly and smoothly. Also, since the tongue-piece-shaped bulb securing piece for fixing and holding the bulb is supported by the elastic wall formed of synthetic resin, there is eliminated a fear that the bulb securing piece will be weakened, so that the bulb can be held positively in a removal preventive manner.

Also, according to the invention, the bulb can be inserted into the bulb insertion opening very lightly and, after inserted, the bulb can be positively prevented against slippage. Therefore, the bulb can be inserted into the bulb socket simply and positively and, after inserted, the bulb can be fixed and held positively.

Further, according to the invention, since the bulb can be held in a well-balanced manner within the bulb insertion opening, even when the bulb is used for a long period of time, the bulb is surely prevented from being loosened.

Still further, according to the invention, because the bulb socket part and connector socket part are formed integrally with each other, the electricity supply cord can be connected to the bulb socket easily.

Yet further, according to the invention, the provision of the crank portion in the contact terminal can increase the placement area of the contact terminal within the bulb insertion opening, which can improve the state of storage of the contact terminal within the bulb insertion opening to thereby accordingly reduce the possibility of the contact terminal being loosened.

Moreover, according to the invention, since the frame-shaped vertical wall formed in the peripheral edge of the crank portion of the contact terminal is engaged with the groove formed in the periphery of the contact surface of the crank portion on the bulb insertion opening side, the contact terminal can be stored properly within the bulb insertion opening, thereby reducing the possibility of the contact terminal being loosened accordingly. Also, because the rigidity strength of the contact terminal can be enhanced by the reinforcing beads provided in the crank portion, the contact terminal can be made accordingly difficult to be deformed when the bulb or electricity supply connector is inserted or removed, so that the contact terminal can be used reliably for a long period of time.

In addition, according to the invention, since the pushing shoulder portion of the contact terminal is pushed by use of a pushing jig, the contact terminal can be pushed into the bulb insertion opening in a well-balanced manner and, therefore, the contact terminal can be mounted into the bulb socket smoothly and accurately.

What is claimed is:

1. A bulb socket comprising:

a bulb socket main body having a bulb insertion opening defined by an internal wall;

a metal contact terminal provided in said bulb insertion opening, said contact terminal including a tongue-shaped bulb securing piece for retaining a bulb inserted into said bulb insertion opening; and an elastic wall extending from said bulb socket main body along said bulb securing piece to flexibly support said bulb securing piece;

wherein said elastic wall is spaced apart from said internal wall and elastically deformable toward said internal wall.

2. A bulb socket as set forth in claim 1, wherein said bulb securing piece includes a bulb securing bent portion projecting away from said elastic wall and toward an interior of said bulb insertion opening.

3. A bulb socket as set forth in claim 2, wherein a distal end of said bulb securing bent portion extends beyond said elastic wall.

4. A bulb socket as set forth in claim 1, wherein said bulb securing piece is centrally located in a width direction of said contact terminal.

5. A bulb socket as set forth in claim 4, wherein said contact terminal further includes two contact hold pieces respectively formed on opposite sides in the width direction thereof.

6. A bulb socket as set forth in claim 1, wherein said bulb socket main body has a connector insertion opening opposite said bulb insertion opening into which an electricity supply connector is insertable.

7. A bulb socket as set forth in claim 6, wherein said contact terminal includes a connector connection terminal which is formed integrally with said contact terminal and extends into said connector insertion opening.

8. A bulb socket as set forth in claim 7, wherein said contact terminal includes a branch portion extending to said connector connection terminal, such that said contact terminal has a Z-shaped longitudinal section.

9. A bulb socket as set forth in claim 8, wherein said branch portion of said contact terminal further includes:

a peripheral edge provided with a vertical wall and reinforcing beads formed in said vertical wall.

10. A bulb socket as set forth in claim 1, wherein said metal contact terminal further includes a tongue-shaped contact hold piece contactable with an electric contact portion of said bulb.

11. A bulb socket as set forth in claim 10, wherein said contact terminal further includes a pushing shoulder portion provided between said bulb securing piece and said contact hold piece for pushing said contact terminal into said bulb insertion opening from the opening side thereof.

12. A bulb socket as set forth in claim 11, wherein said contact terminal includes a lance located below said pushing shoulder portion and enageable with a securing portion formed on the bulb socket main body to thereby restrain said contact terminal against removal.

13. A bulb socket as set forth in claim 1, wherein said elastic wall is cantilevered.

* * * * *